US011415313B2

(12) United States Patent
Stano

(10) Patent No.: US 11,415,313 B2
(45) Date of Patent: Aug. 16, 2022

(54) HAND PORTABLE VOTIVE DEVICE HAVING ELECTRIC LIGHT EMITTING DEVICE

(71) Applicant: Raffaele Stano, Grosseto (IT)

(72) Inventor: Raffaele Stano, Grosseto (IT)

( * ) Notice: Subject to any disclaimer, the term of this patent is extended or adjusted under 35 U.S.C. 154(b) by 249 days.

(21) Appl. No.: 16/956,599

(22) PCT Filed: Dec. 20, 2018

(86) PCT No.: PCT/IB2018/060444
§ 371 (c)(1),
(2) Date: Jun. 21, 2020

(87) PCT Pub. No.: WO2019/123377
PCT Pub. Date: Jun. 27, 2019

(65) Prior Publication Data

US 2021/0148563 A1 May 20, 2021

(30) Foreign Application Priority Data

Dec. 22, 2017 (IT) ..... 202017000149286

(51) Int. Cl.

| | |
|---|---|
| ***F21V 21/40*** | (2006.01) |
| ***F21V 37/00*** | (2006.01) |
| ***F21K 9/238*** | (2016.01) |
| ***F21K 9/232*** | (2016.01) |
| ***F21V 23/04*** | (2006.01) |
| *F21L 4/02* | (2006.01) |

(52) U.S. Cl.
CPC ..... *F21V 37/0095* (2013.01); *F21K 9/232* (2016.08); *F21K 9/238* (2016.08); *F21V 21/406* (2013.01); *F21V 23/0414* (2013.01); *F21V 23/0485* (2013.01); *F21L 4/027* (2013.01)

(58) Field of Classification Search
CPC .. F21V 21/406; F21V 23/0485; F21V 23/007; F21V 23/0414; F21L 4/00; F21L 4/027
See application file for complete search history.

(56) References Cited

U.S. PATENT DOCUMENTS

| | | | | |
|---|---|---|---|---|
| 3,760,177 A * | 9/1973 | Levy | F21S 6/00 | 362/314 |
| 4,187,532 A * | 2/1980 | Naffier | H01R 33/945 | 362/186 |
| 5,152,602 A * | 10/1992 | Boschetto | F21S 6/001 | 362/802 |
| 6,929,381 B2 * | 8/2005 | Peterson | F21S 9/037 | 362/202 |

(Continued)

*Primary Examiner* — Ismael Negron
(74) *Attorney, Agent, or Firm* — ArentFox Schiff LLP; Michael Fainberg

(57) ABSTRACT

A votive device includes a grip; a lamp holder fixed to the grip and having a first electrical lamp holder contact and a second lamp holder electrical contact; a first device electrical contact and a second device electrical contact exposed to the outside surface of the grip and arranged at a predetermined mutual distance so as to be touched simultaneously by a user's hand when gripping said grip; a first electrical conductor directly connecting the first lamp holder electrical contact and the first device electrical contact, and a second electrical conductor directly connecting the second lamp holder electrical contact to the second device electrical contact.

20 Claims, 3 Drawing Sheets

(56) References Cited

U.S. PATENT DOCUMENTS

| | | | | |
|---|---|---|---|---|
| 6,981,786 | B2 * | 1/2006 | Yao | F21S 6/001 362/276 |
| 9,395,061 | B2 * | 7/2016 | Yang | F21S 6/001 |
| 9,683,713 | B2 * | 6/2017 | Chartrand | F21V 1/16 |
| 11,300,261 | B2 * | 4/2022 | Chan | F21S 9/02 |
| 2005/0007779 | A1 * | 1/2005 | Nozawa | F21S 9/02 362/253 |
| 2006/0146544 | A1 * | 7/2006 | Leung | F21S 6/001 362/392 |
| 2007/0223217 | A1 * | 9/2007 | Hsu | H02J 7/0042 362/183 |
| 2008/0094825 | A1 * | 4/2008 | Silver | H05B 47/165 362/161 |
| 2014/0313694 | A1 * | 10/2014 | Patton | F21S 10/046 362/362 |

* cited by examiner

HAND PORTABLE VOTIVE DEVICE HAVING ELECTRIC LIGHT EMITTING DEVICE

FIELD OF THE INVENTION

The present invention relates to a grippable lighting device, for example for votive use. Such a device is intended to replace a torch or candle, which are traditionally held by people forming a procession, for example of the religious type.

BACKGROUND ART

The use of votive processions in religious field has been known since remote times, in which a number of people walk in a line, holding a lit candle or torch.

Such a practice involves various disadvantages.

In particular, the wax candle results in the melting of the wax close to the wick and the dripping thereof in a melted state, which can reach the hand of the person holding it or which can drip onto the road surface, thus making it slippery.

Furthermore, the use of a flame is subject to the environmental conditions, such as wind and rain.

The need is thus felt to provide a substitute for such a candle, which has not the aforesaid disadvantages.

Electric torches are also known, comprising an inner space for accommodating one or more electric batteries and an electric light source supplied by such batteries.

Such known electric torches are not adapted to replace traditional candles or torches since processions generally last several hours in a row and the battery charge would not be sufficient to supply the light source for the whole duration of the procession. Therefore, it would be necessary to replace the batteries several times and, thus carry a considerable number of them to cover the whole duration of the procession.

In particular, none of these solutions suggests a portable and grippable votive lighting device capable of replacing candles or torches during a procession.

SUMMARY OF THE INVENTION

It is an object of the present invention to conceive and provide a portable and grippable votive lighting device, which allows to meet the aforesaid needs and at least partially overcome the drawbacks stated above with reference to the prior art.

Furthermore, it is a task of the present invention to provide a portable and grippable votive lighting device capable of replacing candles or torches during a procession.

These and further objects and advantages are achieved by a portable and grippable votive lighting device according to the independent claim.

Further objects, solutions and advantages are present in the following embodiments described below and claimed in the dependent claims.

BRIEF DESCRIPTION OF THE DRAWINGS

The invention will be shown below by means of the description of some embodiments thereof, given by way of non-limiting example, with reference to the accompanying drawings, in which.

DESCRIPTION OF PREFERRED EMBODIMENTS

Figure 1:
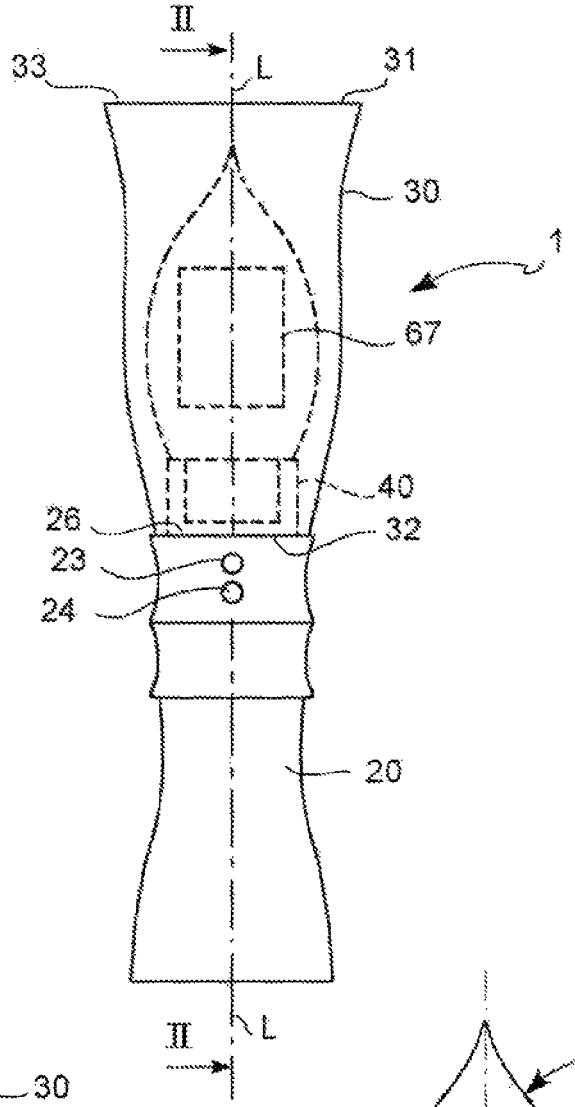
FIG. 1 shows a side view of a portable and grippable votive lighting device according to the present invention.
Figure 2:
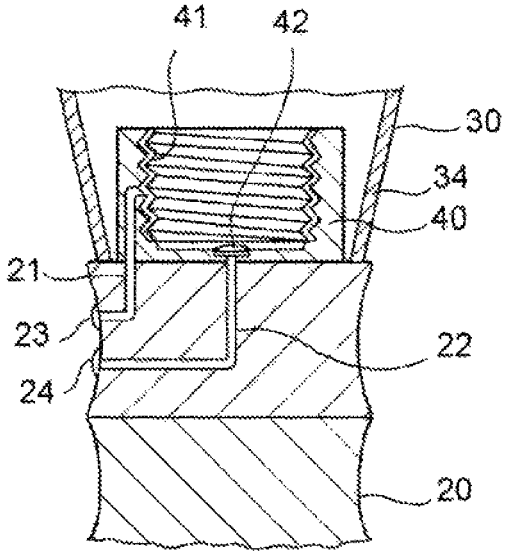
FIG. 2 shows a detail of a sectional view of the device in FIG. 1 through a section plane II passing along the main direction L-L.
Figure 3:
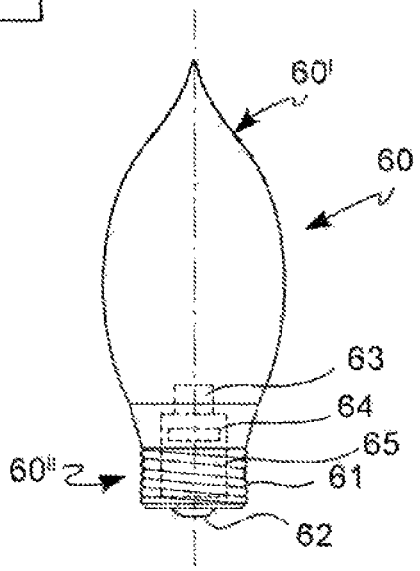
FIG. 3 shows a side view of an exemplary light bulb which can be mounted in the device in FIG. 1.
Figure 4:
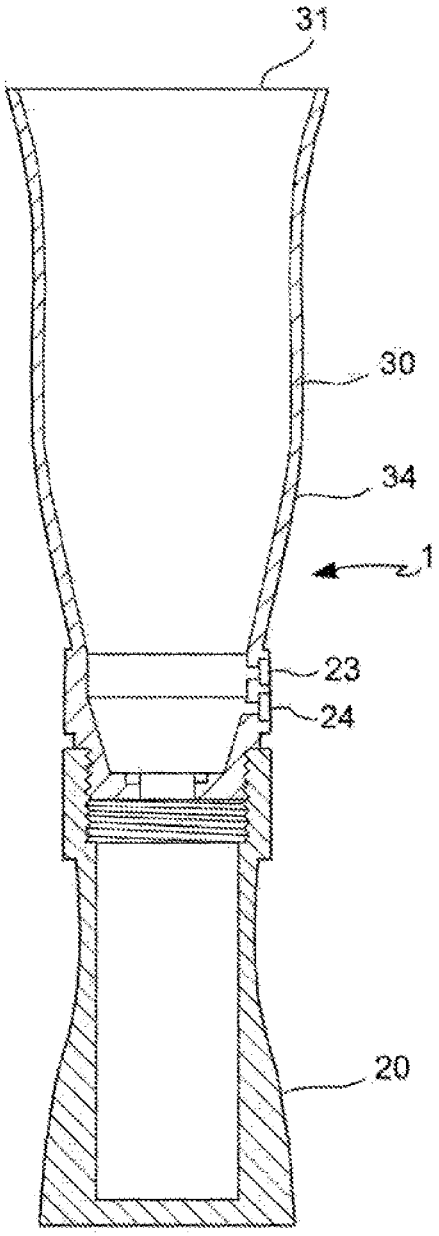
FIG. 4 shows a sectional view though the section plane II of the device in FIG. 1, in which the lamp holder has been omitted for simplicity of depiction.
Figure 5:
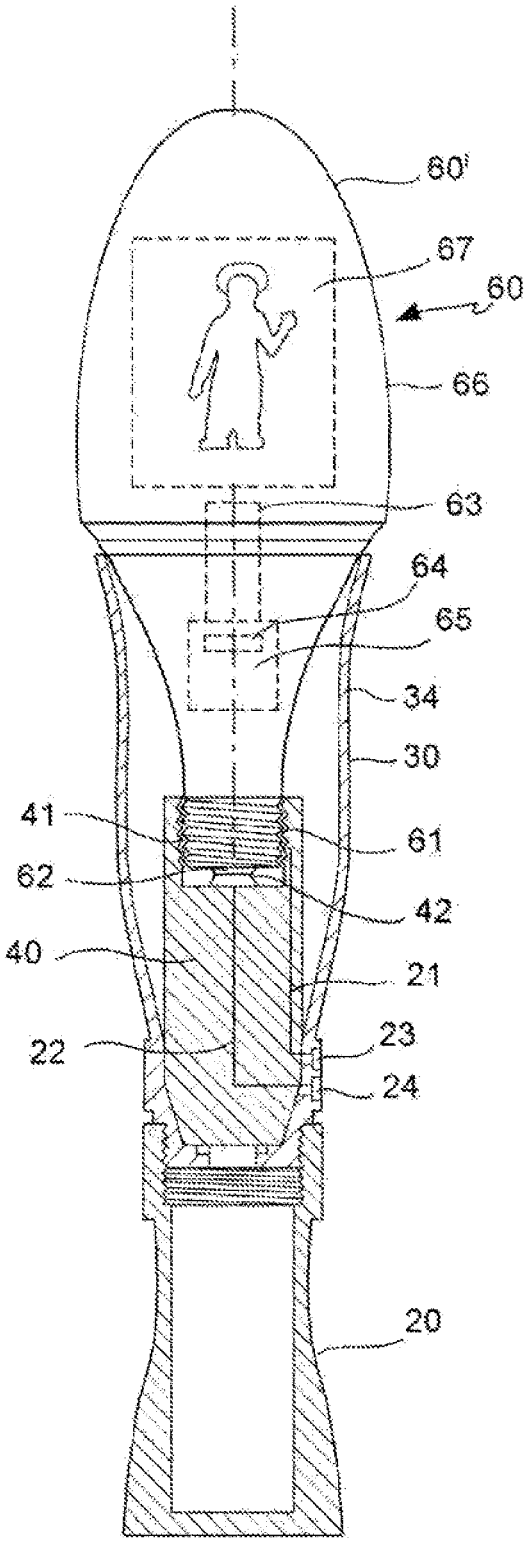
FIG. 5 shows a partial sectional view of an embodiment of the device in FIG. 1, in which the light bulb is arranged with the light portion thereof protruding outside the sleeve portion, and in which the lamp comprises a visible image at least when the lamp is lit.
Figure 6:
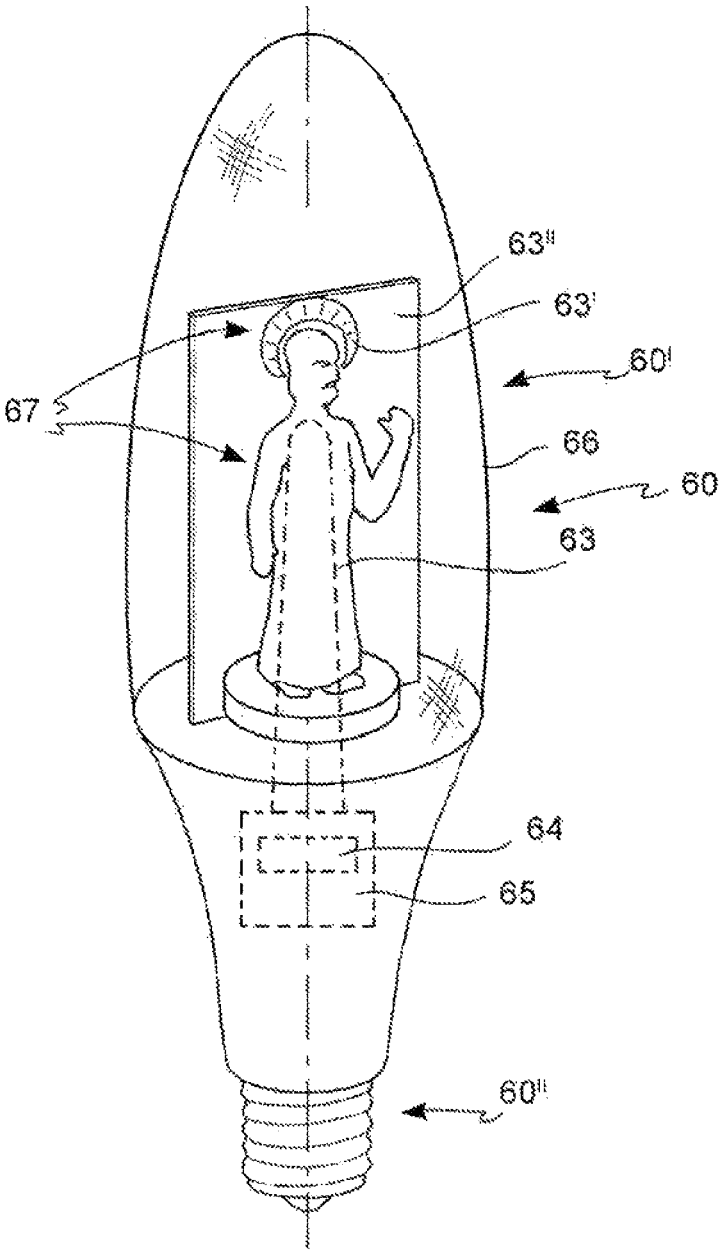
FIG. 6 shows a perspective view of a light bulb according to the present innovation, having a three-dimensional statue which is lit inside a transparent dome of the light portion of the light bulb.

With reference to the figures, a portable and grippable votive lighting device is indicated as a whole by reference numeral 1.

The device 1 comprises a grip 20, a lamp holder 40 connected to said grip 20 and comprising a first lamp holder electrical contact 41 and a second lamp holder electrical contact 42.

The device 1 further comprises a first device electrical contact 23 and a second device electrical contact 24 surfacing and exposed outside said grip 20 and arranged at a predetermined mutual distance, so as to be touched simultaneously by a user's hand when gripping said grip 20.

The device further comprises a first electrical conductor 21 which preferably directly connects said first lamp holder electrical contact 41 and said first device electrical contact 23, and a second electrical conductor 22 which preferably directly connects said second lamp holder electrical contact 42 to said second device electrical contact 24.

According to an embodiment, the device 1 comprises a light bulb 60 which defines a light portion 60' comprising a light source 63, and an attachment portion 60" comprising a first light bulb electrical contact 61 and a second light bulb electrical contact 62 exposed outside said light bulb 60 and electrically connected to said light source 63.

The light bulb 60 is accommodated into said lamp holder 40 so that the first light bulb electrical contact is in contact with, or touches, the first lamp holder electrical contact 41, and the second light bulb electrical contact 62 is in contact with, or touches, the second lamp holder electrical contact 42.

According to an embodiment, the light bulb comprises an electricity source 64, and an electronic circuit 65 which connects said light source 63 to said electricity source 64.

The light source 63, the electricity source 64 and the electronic circuit 65 are all integrated within said light bulb 60.

According to an embodiment, the electricity source 64 comprises a preferably rechargeable, electric battery.

According to an embodiment, the electronic circuit 65 is configured to recharge said rechargeable battery when said light bulb 60 is supplied from the outside by means of the first light bulb electrical contact 61 and the second light bulb electrical contact 62.

The electronic circuit 65 is configured to keep said light source lit for a time interval during which the first light bulb electrical contact 61 and the second light bulb electrical contact 62 are placed in electrical connection to each other by means of a person's touch.

In other words, the electronic circuit 65 is configured to light the light bulb when both contacts are simultaneously touched by one person.

According to an embodiment, the grip 20 is elongated in shape and extends along a main rectilinear direction L-L.

According to an embodiment, the device 1 comprises a sleeve portion 30 having an engagement end 32 fixed to said grip 20, a free end 33 opposed to the engagement end 32, a sleeve wall 34 between said engagement end 32 and said free end 33.

According to an embodiment, the lamp holder 40 is connected, or fixed, inside the sleeve portion 30.

According to one embodiment, the sleeve portion 30 is removably fixed to the grip 20, preferably at the engagement end 32.

According to an embodiment, the sleeve portion 30 extends along said main direction L-L.

According to an embodiment, the free sleeve end 33 has an opening 31 for accessing the lamp holder 40.

According to one embodiment, the sleeve portion 30 is goblet-shaped.

According to an embodiment, the sleeve portion 30 is configured to accommodate the light bulb 60 therein.

In this case, the sleeve portion 30 can be at least partially translucent or transparent. The sleeve portion 30 thus forms a lampshade. Such an embodiment is shown in FIG. 1, for example.

According to an embodiment, the sleeve portion 30 is configured to cause the light portion of the light bulb 60 to at least partially protrude outside the sleeve portion 31.

According to an embodiment, the device 1 comprises at least one image 67, preferably a religious image or a votive image.

According to an embodiment, the image is associated with the sleeve portion 30 and is visible through, or applied to, said sleeve wall 34.

In other words, the image is printed or engraved on the lampshade. Such an image is visible at least when the light bulb is lit. For example, it may also not be visible when the light bulb is off.

According to another embodiment, the image 67 is associated with the light bulb 60 and is applied to the light portion 60' of the light bulb 60, or associated with the light bulb 60 so as to be lit by the light source 63.

In this case, the sleeve portion might also be opaque, i.e. not transparent to the light.

According to an embodiment, the predetermined distance between the first electrical device contact 23 and the second electrical device contact 24 is from 3 mm to 20 mm, preferably of about 10 mm.

According to an embodiment, the grip 20 and/or the sleeve portion, or lampshade 30 are obtained from a plastic material.

According to an embodiment, the device 1 has a cylindrical symmetry about a main direction L-L.

According to a preferred embodiment, the light source 63 comprises a LED light source.

According to an embodiment, the image 67 is a three-dimensional figure arranged inside said light portion 60', said three-dimensional figure being arranged to be lit by said light source 63.

According to an embodiment, the three-dimensional FIG. 67 is lit from the inside by said light source 63, said three-dimensional FIG. 67 being at least partially transparent or translucent to the light, or comprising openings which can be crossed by the light from said light source 63.

According to an embodiment, the three-dimensional FIG. 67 is a statue, preferably a votive statue.

According to an embodiment, the light portion 60' comprises a second light source 63' connected to said electronic circuit 65 and adapted to light a specific part of said light portion 60'.

According to an embodiment, the specific part of said light portion comprises a halo associated with the statue 67.

According to an embodiment, the second light source 63' comprises at least one LED, or at least a LED filament, fixed or printed on a transparent support plate 63".

According to an embodiment, the light portion 60' of the light bulb 60 comprises a transparent dome 66 containing said three-dimensional FIG. 67 therein.

According to an embodiment, the second light source 63' is inside the light portion 60', for example inside the transparent dome 66.

According to an embodiment, the specific part of said light portion 60' is inside the light portion 60', or inside the transparent dome 66.

According to an embodiment, the transparent support plate 63" is inside the transparent dome 66.

According to a further aspect of the present invention, the aforesaid objects and advantages are achieved by a light bulb 60 as described above.

Those skilled in the art can make modifications and adaptations to the above-described embodiments of the device, and replace elements with others which are functionally equivalent in order to meet contingent needs, without departing from the scope of the following claims. Each of the features described as belonging to a possible embodiment can be made irrespective of the other described embodiments.

The means and materials to carry out the various described functions can be of a varying nature, without departing from the scope of the invention.

The drawings are not necessarily to scale.

All the features described herein can be combined according to any combination, except for combinations in which at least some of such features are mutually exclusive.

The invention claimed is:

1. A portable and grippable votive lighting device, comprising:

a grip;

a lamp holder fixed to said grip and comprising a first electrical lamp holder contact and a second electrical lamp holder contact;

a first device electrical contact and a second device electrical contact surfacing and exposed outside said grip and arranged at a predetermined mutual distance, so as to be touched simultaneously by a user's hand when gripping said grip;

a first electrical conductor which directly connects said first lamp holder electrical contact and said first device electrical contact, and a second electrical conductor which directly connects said second electrical lamp holder contact to said second device electrical contact.

2. A votive lighting device according to claim 1, comprising a sleeve portion having an engagement end fixed to said grip, a free end opposed to the engagement end, a sleeve wall between said engagement end and said free end, and wherein the lamp holder is fixed inside said sleeve portion.

3. A votive lighting device according to claim 1, wherein the predetermined distance between the first device electrical contact and the second device electrical contact is from 3 mm to 20 mm, preferably of about 10 mm.

4. A votive lighting device according to claim 1, wherein said device is cylindrically symmetric in shape about a main direction (L-L).

5. A votive lighting device according to claim 1, comprising at least one image, preferably a religious image or a votive image, and wherein said image is associated with said sleeve portion and is visible through, or applied to, said sleeve wall.

6. A votive lighting device according to claim 1, comprising:

a light bulb, said light bulb defining a lighting portion comprising a light source, and an attachment portion comprising a first light bulb electrical contact and a second light bulb electrical contact exposed outside said light bulb and electrically connected to said light source, said light bulb being accommodated into said lamp holder so that the first light bulb electrical contact touches the first lamp holder electrical contact and the second light bulb electrical contact touches the second lamp holder electrical contact.

7. A votive lighting device according to claim 6, wherein said light bulb further comprises an electricity source and an electronic circuit which connects said light source to said electricity source, wherein said light source, said electricity source and said electronic circuit are all integrated into said light bulb, wherein said electronic circuit is configured to keep said light source lit for a time interval during which the first light bulb electrical contact and the second light bulb electrical contact are placed in electrical connection to each other by means of a person's touch.

8. A votive lighting device according to claim 6, wherein said light source also comprises a LED light source.

9. A votive lighting device according to claim 8, wherein the free sleeve end has an opening for accessing the lamp holder.

10. A votive lighting device according to claim 8, wherein the sleeve portion is goblet-shaped.

11. A votive lighting device according to claim 8, wherein the sleeve portion is configured to receive the light bulb therein, and wherein the sleeve portion is at least partially translucent or transparent, said sleeve portion forming a lampshade.

12. A votive lighting device according to claim 8, wherein the sleeve portion is configured to cause said light portion of said light bulb to at least partially protrude outside said sleeve portion through said sleeve opening.

13. A votive lighting device according to claim 12, wherein said image is associated with said light bulb; and wherein the image is applied on said light portion of said light bulb, or wherein the image is arranged so as to be lit by said light source.

14. A votive lighting device according to claim 13, wherein the image is a three-dimensional figure arranged inside said light portion, said three-dimensional figure being arranged to be lit by said light source.

15. A votive lighting device according to claim 14, wherein the light portion comprises a transparent dome containing said three-dimensional figure therein.

16. A votive lighting device according to claim 14, wherein the three-dimensional figure is lit from the inside by said light source, said three-dimensional figure being at least partially transparent or translucent to the light or comprising openings which can be crossed by the light from said light source.

17. A votive lighting device according to claim 16, wherein the light portion comprises a second light source connected to said electronic circuit and adapted to light a specific part of said light portion.

18. A votive lighting device according to claim 14, wherein the three-dimensional figure comprises a statue, preferably a votive statue.

19. A votive lighting device according to claim 18, wherein the specific part of said light portion comprises a halo associated with the statue.

20. A votive lighting device according to claim 19, wherein the second light source comprises at least one LED, or a LED filament, fixed or printed on a transparent support plate.

* * * * *